US009728886B2

(12) United States Patent
Riedel et al.

(10) Patent No.: US 9,728,886 B2
(45) Date of Patent: Aug. 8, 2017

(54) COUPLING PART FOR AN ELECTRICAL CONDUCTOR

(71) Applicant: NEXANS, Paris (FR)

(72) Inventors: Richard Riedel, Floss (DE); Dietmar Volkl, Plossberg (DE); Otto Nachbauer, Floss (DE)

(73) Assignee: NEXANS, Paris (FR)

( * ) Notice: Subject to any disclaimer, the term of this patent is extended or adjusted under 35 U.S.C. 154(b) by 0 days.

(21) Appl. No.: 15/189,116

(22) Filed: Jun. 22, 2016

(65) Prior Publication Data

US 2016/0380379 A1 Dec. 29, 2016

(30) Foreign Application Priority Data

Jun. 25, 2015 (EP) ..... 15305987

(51) Int. Cl.
*H01R 13/58* (2006.01)
*H01R 13/52* (2006.01)

(52) U.S. Cl.
CPC ..... *H01R 13/521* (2013.01); *H01R 13/5216* (2013.01)

(58) Field of Classification Search
CPC . H01R 13/5205; H01R 13/5216; H01R 43/24
USPC ..... 439/604, 686
See application file for complete search history.

(56) References Cited

U.S. PATENT DOCUMENTS 6,150,607 A * 11/2000 Weyl ..... H01B 17/308 16/2.1
8,137,136 B1 * 3/2012 Bench ..... H01R 13/5216 439/604
2002/0031934 A1 3/2002 Hara et al.
2010/0055953 A1 3/2010 Walker et al.

FOREIGN PATENT DOCUMENTS

| | | |
|---|---|---|
| DE | 3417811 | 10/1985 |
| DE | 3623927 | 10/1987 |
| DE | 102008031085 | 1/2010 |
| EP | 1821376 | 8/2007 |

OTHER PUBLICATIONS

Search Report dated 2015.

* cited by examiner

*Primary Examiner* — Phuong Dinh
(74) *Attorney, Agent, or Firm* — Sofer & Haroun, LLP

(57) ABSTRACT

A coupling part for an electrical line has an insulator having a receiving side and an oppositely lying plug-in side and throughholes, in which are arranged insulated electrical contact elements relative to each other, to which, in the mounted position, the electrical conductors of the line are connected on the receiving side of the insulator. A surrounding prefabricated housing is mounted over the connecting point of the conductors and contact elements, so that on the one side it stretches up to and over the insulator and on the other side up to and over the line.

1 Claim, 1 Drawing Sheet

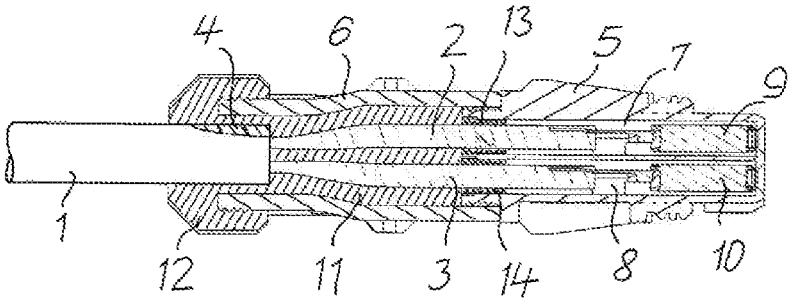
4
6
2
13
5
7
9
1
12
11
3
14
8
10

COUPLING PART FOR AN ELECTRICAL CONDUCTOR

RELATED APPLICATION

This application claims the benefit of European Patent Application No. 15 305 987.8, filed on Jun. 25, 2015, the entirety of which is incorporated by reference.

BACKGROUND

Field of the Invention

The invention relates to a coupling part for an electrical line which has at least two wires consisting of insulated electrical conductors and one jacket of insulation material surrounding the wires jointly, that has an insulator having a receiving side and an oppositely lying plug-in side and throughholes, in which are arranged insulated electrical contact elements relative to each other, to which in the mounted position electrical conductors of the line are connected on the receiving side of the insulator, wherein a surrounding prefabricated housing composed of insulation material is mounted over the connecting point of the conductors and contact elements, so that on the one side it stretches up to and over the insulator and on the other side up to and over the line.

Such a coupling part is described, for example, in DE 10 2008 031 085 A1.

Description of Related Art

"Coupling part" according to the invention is a part of a plug connection, in which plug pins or sleeves can be used as contact elements arranged in a mechanically stable insulator. The corresponding counter contacting contact elements, implemented to make the plug connection, can be found in a second coupling part of the plug connection. The contact elements are inside each insulator with the stripped wire in a coupling part bound to a protruding electrical line, which has at least two wires which are surrounded by a common casing which are insulated electrical lines. In this type of coupling part, the connecting point of the contact parts and the lines should be sealed relative to moisture and there should be a moisture-proof connection to each of the lines. In this connection, moisture from the coupling part penetrating the wires should especially be prevented because the moisture can follow the wires up to the electrical contact at the furthest end and spread out.

A coupling part for electrical lines with an insulator receiving contact element and with a moisture-proof connection of the lines is known. For example, one is manufactured by injection molding an external protective body of insulating material, in which the inner lines are sealed off against the penetration of moisture. In order to prevent the penetration of the contact element by the highly viscous spraying material of the injection molding of the protective body, according to DE 34 17 811 C1, before the injection molding a hot contact adhesive is applied on the receiving side of the insulator. According to DE 36 23 927 C1 pipe pieces, which protrude into the opening of the insulator in which each conductor is positioned, composed of insulation material, are arranged on the conductors before the injection molding. The coupling part according to EP 1 821 376 A1, has pivoting locking flaps mounted on the insulator, which lie tightly on the wires of the line before injection molding the protective body and thereby seal the insulator. All these known coupling parts add a relatively high cost to their manufacture.

US 2002/0031934 A1 discloses a connector for electrical lines which has an outer housing into which, in mounting position, is plugged an inner housing. The inner housing has several parallel chambers containing contacts. Single wires are connected to the contacts, the wires having a distance to each other in mounting position. The front end of the outer housing is closed by a sealing body consisting of hot-melt glue in a moisture-proof fashion.

EP 2 161 788 A1 describes a coupling part with a housing in which are introduced wires being arranged side by side. In one chamber of the housing is arranged a sealing body consisting, for example, of an epoxy resin, and which abuts to one end of the insulator and to the housing and also surrounds parts of the wires lying within the housing.

In the previously mentioned DE 10 2008 085 A1 a coupling part for an electrical conductor is described that has an insulator composed of insulation material, in which oppositely placed insulated electrical contact elements are arranged, that in the mounted position the line is connected on the receiving side of the insulator to the electrical conductor. A same surrounding prefabricated housing composed of insulation material is mounted over the connection point of the conductor and the contact elements, so that it extends on the one hand over the insulator and on the other hand over the lines. The inner space of the housing, while leaving the plug side of the insulator in the area of the same protruding line up to the receiving side of the insulator, is completely filled with a foam body generated from components, which foams up after filling of the same in the housing. Generating the foam body is time consuming and gaps may remain between the housing and the foam body as well as between the same and the sealed parts in which moisture can enter.

OBJECTS AND SUMMARY

The invention is based on the object of the previously described coupling part more efficiently sealing against moisture.

This object according to the invention is met in that

- the inner space of the housing, in the area of the line extending into the housing, up until the insulator, is completely filled with a thermoplastic glue on the basis of polyamide which adheres tightly and moisture-proof on the enclosed wires of the line and the housing of the coupling part, as well as on the jacket of the protruding line in the housing, and which also rests as a type of bulge against the housing, and
- that the wires of the line extending into the throughholes of the insulator are each surrounded by a seal which lies tightly to the wires on one side and the walls of the throughholes on the other side.

This coupling part is particularly simply constructed and nevertheless protected against moisture. After completion of the conductive connection between the contact elements and the electrical conductor lines, the prefabricated housing is laid around the contact point, which means that it reaches over the surrounding jacket of the same and on the other side up to over the insulator. After an application of the polyamide as a hot melt, in the following named "PA-hot melt," the mounted housing is brought into, for example, an injection molding tool in which the inner space is in connection range of the line, and is completely filled up to the insulator and protrudes over the jacket of the line. The contact elements lying in the throughholes of the insulator are sealed against the PA-hot melt by the seals which lie tightly against the wires on one side and the walls of the throughholes on the other side. The PA-hot melt adheres to all the surrounding parts of the finished coupling part and also especially on the walls of the prefabricated housing. That applies to all the possible materials which the parts and the housing are composed of. For this reason, the line as well as the contact points between conductors and contact elements is effectively protected from moisture through the PA-hot melt which acts as a type stopper or plug.

The PA-hot melt is a material on the basis of polyamide that through the addition of additives, such as organic elements, becomes sticky when heated with high temperatures. Accordingly, it will be warmed for the processing and, namely for example, heated to a temperature of 200° C. The PA-hot melt will thereby become highly viscous and can be easily introduced into the housing in a predetermined quantity. This can—as previously mentioned—advantageously result, for example, from injection molding. After the end of the filling process, the PA-hot melt quickly cools. As a result, it adheres tightly with all the surrounding parts of the coupling part and especially the walls of the housing.

Little time is required in the filling process of the completely assembled housing, and also at the same time, the sealing body is formed in a short time. The manufacture of coupling parts in greater numbers in continuous process, makes possible a possible shorter cycle time.

BRIEF DESCRIPTION OF THE DRAWINGS

An embodiment of the present subject matter is illustrated in the drawings.

The single FIGURE of the drawing shows the coupling part according to the invention in a sectional view.

DETAILED DESCRIPTION

In the drawing a coupling part K, a type of plug connection connected to the end of an electrical line 1, is schematically illustrated. In the illustrated embodiment the electrical line 1 has two wires 2 and 3 that are surrounded by a common jacket 4 composed of insulation material. They are exposed a predetermined length from the jacket 4. Each wire 2 and 3 is comprised of a surrounding insulating electrical conductor. The line 1 can have more than two wires.

Coupling part K is comprised of an insulator 5 composed of stable insulation material such as for example polyamide (PA) or polypropylenterphthalate (PPT) and a housing 6 composed of insulation material such as for example PA, PPT or thermoplastic polyurethane, which on one side protrudes over the line 1 and on the other side to protrudes over the insulator 5 and lies tightly against the same. In the insulator 5, with a corresponding number of wires of the wire 1, two throughholes 7 and 8 are placed in which the contact elements 9 and 10 are arranged. The contact elements 9 and 10 can be used as plug pins or plug sockets. The insulator 5 has a receiving side on which the conductor of the wires 2 and 3 can be connected and a plug side to plug in a complimentary coupling part or counter contacts. Seals 13 and 14 are arranged on the wires 2 and 3, which lie inside the throughholes 7 and 8. They lie tightly against the wires 2 and 3 on one side and against the walls of the throughholes 7 and 8 on the other side.

The coupling part K is manufactured as follows, for example:

The wires 2 and 4 of the line 1 are initially exposed a predetermined length from the jacket 4. Then, the insulation at the end of the wires 2 and 3 is removed. The conductor is then electrically conductively connected with the contact elements 9 and 10 and the contact elements are then arranged in the throughholes 7 and 8 of the insulator 5. Finally, the prepared arrangement is placed around the housing 6, which on one side surrounds the line 1 and on the other side in tight contact with the same until protruding over the insulator 5. The housing 6 can be pushed before the described assembly on the line 1 and finally brought into the position in the illustrated drawing.

Finally, a PA-hot melt is filled in the housing 6, and namely advantageously placed in an injection molding tool. The sealing body 11 obtained as a result completely fills the housing 6 in the area of the entry point of the line 1. It protrudes close or near to the insulator 5 and surrounds the end of the protruding line 1 in the housing. In accordance with the illustrated drawing, a type of bulge 12 is formed which also rests against the housing 6.

The invention claimed is:

1. A coupling part for an electrical line the electrical line having at least two insulated electrical conductor wires and a common jacket, the coupling part comprising:

an insulator having a receiving side and an oppositely lying plug-in side and throughholes, in which are arranged insulated electrical contact elements relative to each other, to which, in a mounted position, the electrical conductors of the line are connected on the receiving side of the insulator, wherein a surrounding prefabricated housing composed of insulation material is mounted over a connecting point of the conductors and contact elements, so that on the one side it stretches up to and over the insulator and on the other side up to and over the line, wherein the inner space of the housing, in the area of the line extending into the housing, up until the insulator, is completely filled with a thermoplastic polyamide glue which adheres tightly and moisture-proof on the enclosed wires of the line and the housing of the coupling part, as well as on the jacket of a protruding line in the housing, and which also rests as a type of bulge against the housing, wherein the wires of the line extending into the throughholes of the insulator are each surrounded by a seal which lies tightly to the wires on one side and the walls of the throughholes on the other side.

* * * * *